United States Patent [19]

Beremand

[11] 4,215,548

[45] Aug. 5, 1980

[54] FREE-PISTON REGENERATIVE HOT GAS HYDRAULIC ENGINE

[75] Inventor: Donald G. Beremand, Bay Village, Ohio

[73] Assignee: The United States of America as represented by the Administrator of the National Aeronautics and Space Administration, Washington, D.C.

[21] Appl. No.: 950,876

[22] Filed: Oct. 12, 1978

[51] Int. Cl.[3] ..... F02G 1/04

[52] U.S. Cl. ..... 60/520; 417/383

[58] Field of Search ..... 60/520; 62/6

[56] References Cited

U.S. PATENT DOCUMENTS

| | | | |
|---|---|---|---|
| 3,513,659 | 5/1970 | Martini | 417/383 X |
| 3,828,558 | 8/1974 | Beale | 60/520 |
| 3,899,888 | 8/1975 | Schuman | 60/520 X |

*Primary Examiner*—Allen M. Ostrager

*Attorney, Agent, or Firm*—N. T. Musial; J. R. Manning; J. A. Mackin

[57] ABSTRACT

The present invention is directed to a free-piston regenerative hydraulic engine including a displacer piston which is driven pneumatically by a high-pressure or low-pressure gas. Actuation of the displacer piston circulates the working fluid through a heater, a regenerator and a cooler. The present invention includes an inertial mass such as a piston or a hydraulic fluid column to effectively store and supply energy during portions of the cycle. Power is transmitted from the working fluid to a hydraulic fluid across a diaphragm or lightweight piston to achieve a hydraulic power output. The displacer piston of the present invention may be driven pneumatically, hydraulically or electromagnetically. In addition, the displacer piston and the inertial mass of the present invention may be positioned on the same side of the diaphragm member or may be separated by the diaphragm member.

18 Claims, 7 Drawing Figures

FREE-PISTON REGENERATIVE HOT GAS HYDRAULIC ENGINE

GOVERNMENT RIGHTS

The invention described herein was made by an employee of the United States Government, and may be manufactured and used by or for the government for governmental purposes without payment of any royalties thereon or therefor.

BACKGROUND OF THE INVENTION

1. Field of the Invention

The present invention is directed to a free-piston regenerative hydraulic engine having a displacer piston, an inertial mass and a hydraulic output.

2. Prior Art

A number of free-piston Stirling engines have been proposed which utilize a free displacer piston actuated by a gas reservoir pressure or "bounce pressure" acting on a small differential area of the piston. For example, the Dehne patent, U.S. Pat. No. 3,530,681, disclosed a cryogenic refrigerator expander and compressor pistons which are actuated under the influence of refrigerant pressure and hydraulic pressure. The hydraulic pressure entering the drive unit 28 through the hydraulic pumps P1 and P2 acts on the small differential area of the piston rods 15 and 16. The Dehne patent does not disclose a displacer piston, a working piston and a diaphragm as set forth in the present invention.

In addition, a number of prior art Stirling engines have been proposed which include a displacer piston interconnected with a working piston by means of a piston rod. The Kress patent, U.S. Pat. No. 3,630,019, the Gothberg patent, U.S. Pat. No. 3,782,119, the Gartner patent, U.S. Pat. No. 3,889,465, and the Abrahams patent, U.S. Pat. No. 3,886,743, disclose pressure operated engines which include a displacer piston connected to a working piston by means of a piston rod. None of the patents listed above disclose a free displacer piston acting through a free inertial mass in combination with a diaphragm member as proposed in the present invention.

Further, developments have been proposed in the prior art to control the operation of a Stirling engine. The Jaspers patent, U.S. Pat. No. 3,886,744, and the Bergman patent U.S. Pat. No. 3,902,321, disclose a power regulating system in combination with a Stirling engine. However, the Jaspers patent and the Bergman patent do not disclose a free displacer piston and a free inertial piston in combination with a diaphragm as set foth in the present invention.

SUMMARY OF THE INVENTION

It is an object of the present invention to provide a free-piston regenerative engine which will operate from zero to maximum speed and power with an essentially constant PV diagram and efficiency.

Another object of the present invention is to provide a free-piston regenerative engine wherein the operation of the displacer piston is controlled so that the diaphragm may complete its stroke prior to the reversal stroke of the displacer piston.

A further object of the present invention is to provide a free-piston regenerative engine which employs a displacer piston, an inertial mass and a diaphragm which are not mechanically interconnected to each other.

A still further object of the present invention is to provide a regenerative engine which includes a displacer piston, an inertial mass and a diaphragm member in combination with each other.

These and other objects of the present invention are fulfilled by constructing a free-piston regenerative engine which includes a piston chamber being slightly enlarged at one end thereof. A displacer piston is designed to include an enlarged upper portion which slidably mates with the enlarged portion of the piston chamber. In addition, the displacer piston includes a downwardly projecting portion of smaller diameter which slidably mates with the lower portion of the piston chamber. High and low pressure supplies, near the maximum and minimum working fluid pressures are alternately referenced to the differential piston area between the larger and smaller piston diameters to alternately drive the displacer piston from one end of the chamber to the other. Positioned between the displacer piston and the bottom of the piston chamber is an inertial piston designed to slidably engage the lower portion of the piston chamber. In addition, the free-piston regenerative engine of the present invention includes a diaphragm member which separates the hydraulic chamber, positioned at the bottom of the piston chamber, from the displacer portion and the inertial piston. However, in one embodiment of the present invention, the displacer piston and the inertial piston may be separated by the diaphragm member. In this embodiment, the inertial portion is positioned within the hydraulic chamber.

Further scope of applicability of the present invention, will become apparent in the detailed description given hereinafter; it should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
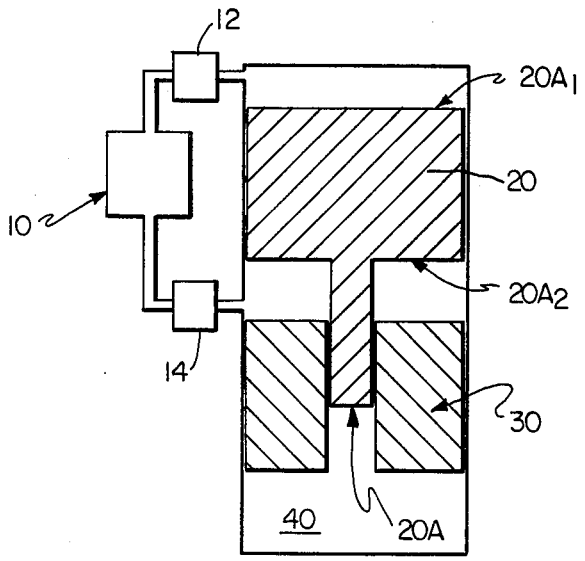
PRIOR ART FIG. 1
FIG. 1 is a schematic view of a Beale's engine which is known in the prior art.

Referring to FIG. 1, a Beale's engine is disclosed which includes a lightweight displacer piston 20 and a heavier working piston 30. The displacer piston 20 includes an upper surface with an area $20A_1$ and includes a downwardly projecting rod having a lower surface with an area 20A. Further, the displacer piston 20 includes a surface with an area $20A_2$ positioned adjacent the connection of the downwardly projecting rod and the main body of the displacer piston.

The downwardly projecting rod of the displacer piston 20 is slidably mounted within an opening in the working piston 30. As is conventional in a Beale's engine, a heater 12, a regenerator 10 and a cooler 14 are positioned in series between the expansion space above the piston 20 and the compression space below the piston 20. A bounce reservoir 40 is positioned in the lower portion of the chamber adjacent the working piston 30 and in communication with the area 20A of the downwardly projecting rod of the displacer piston 20. Work may be extracted from the working piston in a number of ways; electrically with the working piston serving as the armature of a linear alternator; mechanically via a shaft attached to the piston through the chamber wall with an appropriate seal; and pneumatically or hydraulically with an inertial pump or compressor built into the working piston.

One characteristic of a Beale's engine illustrated in FIG. 1 is a free displacer piston 20 which is actuated by a gas reservoir pressure or bounce pressure acting on a small differential area 20A of the displacer piston. The top area $20A_1$ and the bottom area $20A_2$ of the displacer piston 20 are referenced to each other through the heater 12, the regenerator 10, and the cooler 14. The regenerator $\Delta P$ is small to ensure the efficiency of the Beale's engine. The displacer piston 20 will essentially be balanced except for the differential area 20A referenced to the bounce reservoir 40.

Figure 6:
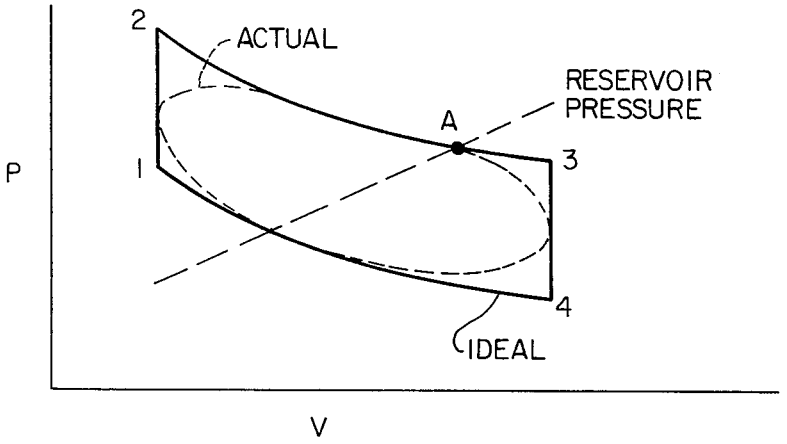
FIG. 6 illustrates a PV diagram.

The PV diagram, illustrated in FIG. 6 is helpful in explaining the operation of the Beale's engine illustrated in FIG. 1:

As the working piston 30 of the Beale's engine moves from point 2 to point 3, as shown in the PV diagram illustrated in FIG. 6, the working fluid pressure drops. Beyond the point A the working fluid pressure falls below the reservoir pressure. During this phase of operation, the force balance on the lightweight displacer piston 20 reverses and returns the displacer piston to the top, or hot end, of the piston chamber. Thus, the working fluid is displaced through the heater 12, the regenerator 10 and the cooler 14 and flows into the cool end of the piston chamber. The pressure of the working fluid is lowered due to the displacement of the working fluid through the heater, the regenerator and the cooler. The working fluid pressure is further lowered by the reduction in temperature. The larger pressure differential between the bounce reservoir and working fluid acts to stop the working piston and move it back towards the displaced end.

As the working piston 30 returns from the point 4 to point 1, as shown in the PV diagram as illustrated in FIG. 6, the working fluid pressure rises until it again exceeds reservoir pressure. Again, the displacer force balance is reversed and returns the displacer piston 20 to the cold end of the piston chamber. Therefore, the working fluid is displaced through the cooler 14, the regenerator 10 and the heater 12 to the top, or hot end, of the piston chamber. This heats the working fluid and further raises the working fluid pressure. The resulting pressure differential on the working piston acts to reverse its motion and move it again away from the displacer end. The cycle then repeats continually.

The Beale's engine illustrated in FIG. 1 will have a natural frequency dependent on the system pressure, volumes and working piston mass. Changing the load on the working piston 30 will change its stroke and the PV diagram. Further, changing the load on the working piston will affect the cycle efficiency. An inherent disadvantage of the Beale's engine is that the displacer piston 20 reverses before the power piston 30 completes its stroke, the PV diagram is thus affected lowering the efficiency of the engine.

The present invention overcomes the deficiencies of the Beale's engine by providing a free-piston regenerative engine which will operate from zero to maximum speed and power with an essentially constant PV diagram and efficiency. The displacer operation of the present invention is controlled so that the power piston completes its stroke prior to the reversal of the displacer piston.

Figure 2:
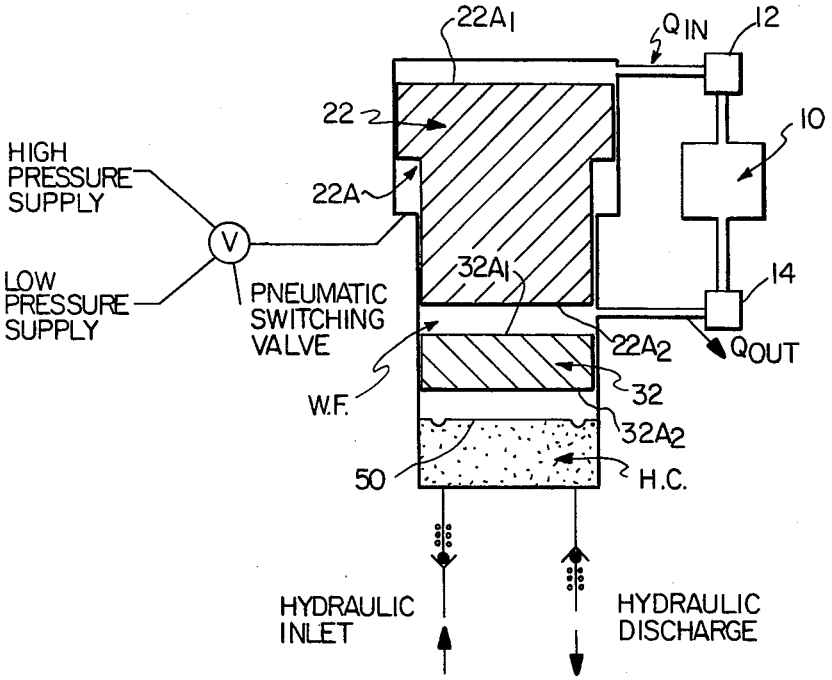
FIG. 2 is a schematic view of the free-piston regenerative engine according to the present invention.
Figure 3:
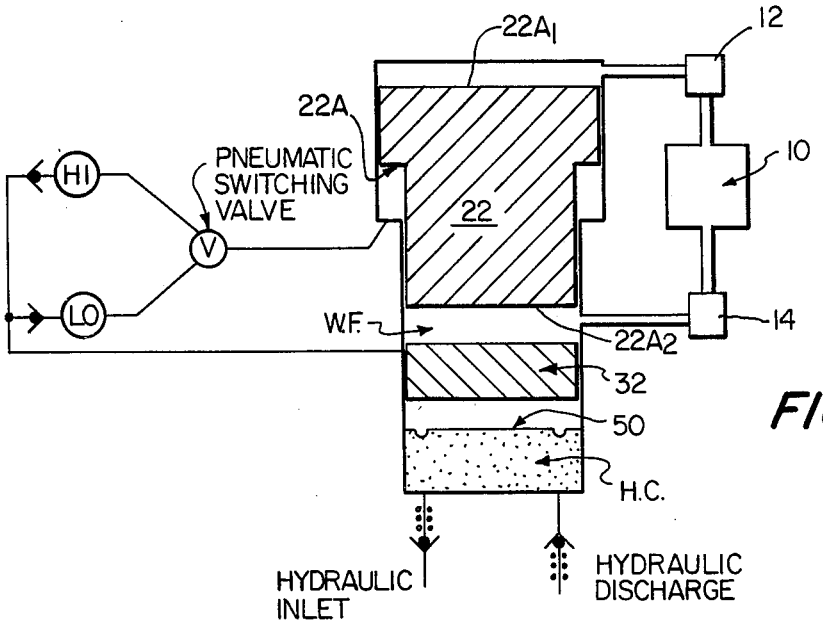
FIG. 3 is a schematic view of a second embodiment of the free-piston regenerative engine according to the present invention.

The free-piston regenerative hydraulic engine of the present invention is shown schematically in FIGS. 2 and 3. The displacer piston 22 is driven pneumatically by referencing either high-pressure or low-pressure gas to a small differential piston area 22A. In this embodiment of the present invention, if a low-pressure, which is below the engine pressure, is referenced to the displacer piston differential area 22A, the displacer piston 22 would move downwardly. This downward movement of the displacer piston 22 would displace gas through the cooler 12, the regenerator 10 and the heater 14 to the top, or hot end, of the piston chamber. This displacement of gas through the cooler, the regenerator and the heater would heat the working fluid, raise the engine pressure and thus cause the inertial piston 32 to be displaced downwardly.

As shown in FIGS. 2 and 3, the downward movement of the inertial piston 32 would compress the small quantity of gas positioned between the inertial piston 32 and the diaphragm 50 until the gas pressure equaled the hydraulic discharge pressure in the hydraulic chamber H.C. If the gas pressure below the inertial piston 32 equals or surpasses the pressure within the hydraulic chamber H.C., the inertial piston 32 and the diaphragm 50 will move downwardly displacing hydraulic fluid through the hydraulic discharge check valve.

The working fluid pressure acts on the inertial piston 32 and displaces it through a distance to produce an incremental quantity of energy. This incremental quantity of energy is absorbed by the acceleration of the inertial piston 32 and the hydraulic fluid together with the pump work of the hydraulic pressure times the flow. Initially, as the inertial piston 32 begins its downward movement, the working fluid W.F. pressure would be higher than the hydraulic pressure in the hydraulic chamber H.C. Therefore, the inertial piston 32 would be accelerated downwardly. As the working fluid W.F. continues to expand, the working fluid pressure would fall below the hydraulic pressure in the hydraulic chamber H.C. Therefore, the inertial piston 32 and the diaphragm would decelerate, eventually stop and thereafter be accelerated upwardly. However, the upward acceleration of the inertial piston 32 and the diaphragm would not be affected because the hydraulic discharge check valve would close. The closing of the hydraulic discharge check valve would cause the hydraulic pressure to drop to match working fluid pressure. Referring to the PV diagram illustrated in FIG. 6, the engine would remain stationary essentially at point 3 of the PV diagram.

By switching the pneumatic valve to reference high pressure gas to the displacer piston area 22A would drive the displacer piston 22 upwardly. This upward movement of the displacer piston 22 would displace the working fluid W.F. through the heater 12, the regenerator 10 and the cooler 14 thus cooling the working fluid and causing the pressure of the working fluid to drop. When the working fluid pressure drops below the hydraulic inlet pressure, the diaphragm and the inertial piston 32 will begin to accelerate upwardly thus raising the working fluid pressure until it is above the hydraulic pressure in the hydraulic chamber H.C. As the working fluid pressure exceeds the hydraulic pressure, the inertial piston 32 and the diaphragm are decelerated and eventually come to a stop. At this point, the engine will again remain stationary until the pneumatic valve is switched to reference low pressure gas to the displacer piston area 22A. Upon referencing low pressure gas to the displacer piston area 22A, the displacer piston 22 again moves downwardly to start a new cycle.

According to the present invention, the engine speed is modulated by controlling the frequency at which the high pressure gas and low pressure gas is applied to the displacer piston area 22A. In this manner, the engine cycling rate may be controlled from zero to maximum speed, whereas the thermodynamic operation of each individual cycle remains essentially constant. Maximum speed of the engine with a full thermodynamic cycle would be achieved when the pressure switching frequency corresponds to the travel time of the inertial piston.

According to the present invention, higher engine frequencies could be achieved by switching the high and low pressure gases referenced to the displacer piston area 22A before the inertial piston 32 and diaphragm complete their full stroke.

However, higher engine frequencies would alter the thermodynamic cycle of the engine and would affect the engine's efficiency. Nevertheless, higher levels of maximum power might be possible at these increased frequencies even though at some loss of efficiency.

As illustrated in FIG. 3, the high and low gas actuation supply pressures may be generated by the engine. This would be accomplished by referencing a high-pressure accumulator and a low-pressure accumulator to the engine through appropriate check valves. In this particular embodiment of the present invention, the high-pressure accumulator would tend to be pressurized to the peak engine cycle pressure and the low-pressure accumulator would tend to be pressurized to the minimum engine cycle pressure.

Referring to FIGS. 2 through 5, as the displacer piston 22, 24 moves downwardly, the working fluid W.F. is heated by being displaced through the cooler 14, the regenerator 10 and the heater 12. This input of heat into the working fluid W.F. is illustrated in FIG. 2 by $Q_{IN}$. As the displacer piston 22, 24 moves upwardly, the working W.F. is cooled by being displaced through the heater 12, the regenerator 10 and the cooler 14. As illustrated in FIG. 2, the cooling of the working fluid W.F. is indicated by $Q_{OUT}$. In addition, the working piston illustrated in FIG. 2 includes an upper surface area $32A_1$, and a lower surface area $32A_2$.

Figure 4:
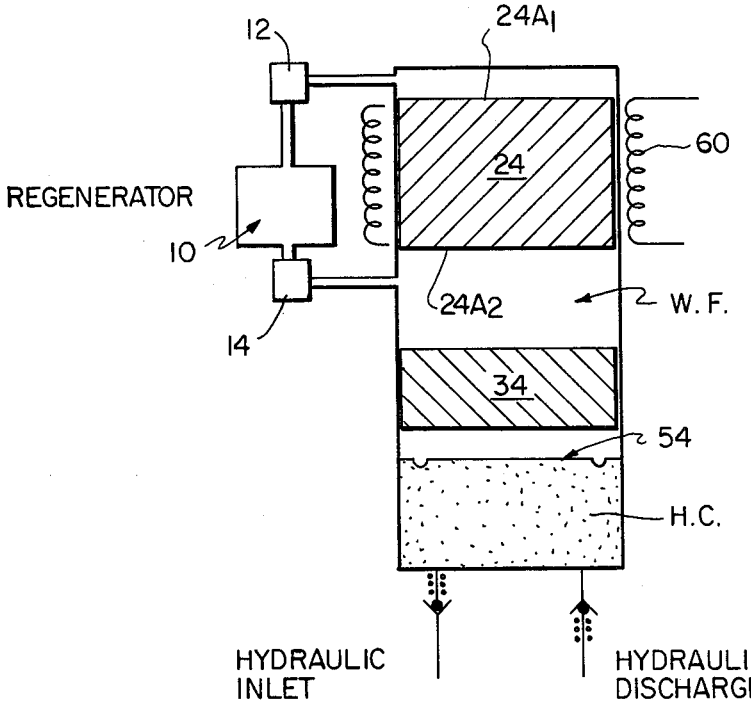
FIG. 4 is a schematic view of an electrically controlled displacer piston of a free-piston regenerative engine according to the present invention.
Figure 5:
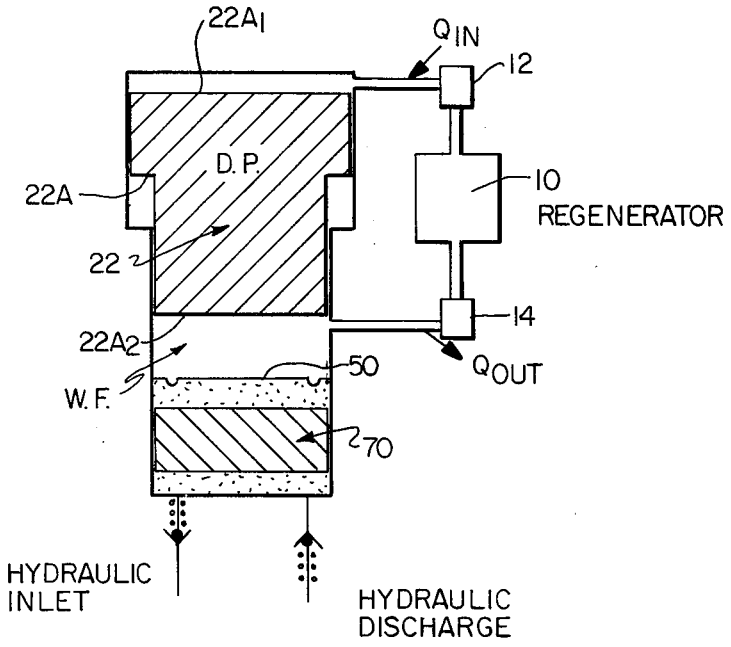
FIG. 5 is a schematic view of another embodiment of the free-piston regenerative engine of the present invention wherein the inertial piston is positioned within the hydraulic chamber.

Referring to FIG. 4, there is illustrated a free-piston regenerative engine which is similar to the engines illustrated in FIGS. 2, 3 and 5. This embodiment of the invention, illustrated in FIG. 4, discloses a displacer piston 24 including an upper surface having an area $24A_1$ and a lower surface having an area $24A_2$. The displacer piston 24 is actuated by means of a solenoid 60 which would alternatively drive the displacer piston 24 upwardly and downwardly according to the frequency of the solenoid switching. Similar to the other embodiments of the present invention, the frequency of the solenoid switching controls the engine speed and power.

Referring in detail to FIG. 4, the free-piston regenerative engine includes an inertial piston 34 which is positioned adjacent to the displacer piston 24. In addition, a diaphragm 54 separates the piston chamber containing the displacer piston and the working piston from the hydraulic chamber H.C. As is conventional in a regenerative engine, a regenerator 10 is referenced to the upper surface area $24A_1$ and the lower surface area $24A_2$ of the displacer piston 24. Positioned between the displacer piston 24 and the inertial piston 34 is the working fluid W.F. which is cyclically displaced through the heater 12, the regenerator 10 and the cooler 14 for sequentially heating and cooling the working fluid.

According to the present invention, any external drive system including pneumatic, electric or hydraulic systems, could be utilized which would provide control of the frequency at which the displacer piston was activated.

Referring to FIG. 5, there is illustrated a free-piston regenerative engine which is similar to the engines illustrated in FIGS. 2 and 3. In this embodiment of the present invention, the working fluid W.F. acts directly on the diaphragm member 50. If the hydraulic fluid mass of the pump and active lines is insufficient to provide the necessary kinetic energy effect, an inertia piston 70 may be positioned within the hydraulic fluid to act as a kinetic storage means. This kinetic energy storage means is necessary to approach a constant temperature process rather than a constant pressure process which would otherwise result. The operation of this embodiment of the present invention is essentially the same as the embodiment illustrated in FIG. 2. However, placing the inertia piston mass 70 in the hydraulic fluid may be advantageous when considering piston and seal designs. In addition, the small quantity of working fluid between the inertia piston 70 and the diaphragm member 50, as illustrated in FIG. 5, would not be, as in FIG. 2, alternatively compressed and expanded thereby eliminating the attendant hysterisis losses.

Figure 7:
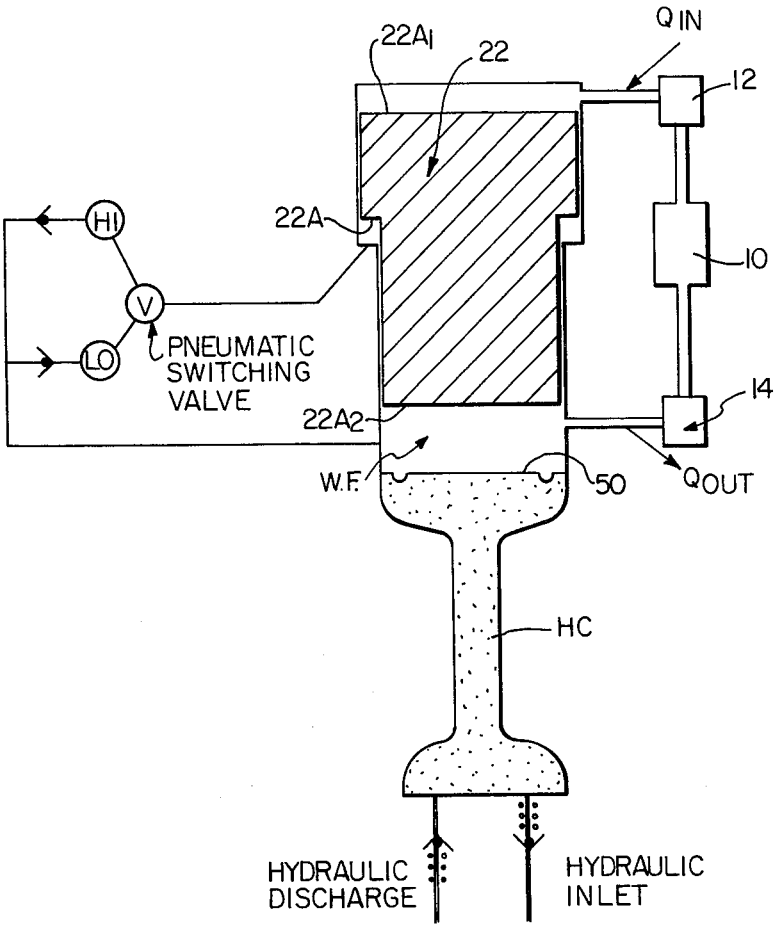
FIG. 7 is a schematic view of a further embodiment of the present invention wherein the fluid within the hydraulic chamber functions as an inertial piston.

Referring to FIG. 7, there is illustrated a free-piston regenerative engine which is similar to the engines illustrated in FIGS. 2 and 3. In this embodiment of the present invention, the working fluid W.F. acts directly on the diaphragm member 50 in a manner similar to the operation of the regenerative engine as illustrated in FIG. 5.

In the embodiment of the present invention illustrated in FIG. 7, the hydraulic discharge and hydraulic inlet lines are of a sufficient size so as to be equivalent to positioning an inertial piston element within the hydraulic chamber H.C. Like characters represented in FIG. 7 are similar to like characters illustrated in FIGS. 2–5.

DESCRIPTION OF OPERATION

The free-piston regenerative engine of the present invention includes a displacer piston which is driven upwardly or downwardly by a pneumatic, hydraulic or electromagnetic frequency switching means. As the displacer piston is actuated upwardly, working fluid is passed through and cooled by means of a cooler in series with a regenerator. As the displacer piston moves downwardly, working fluid passes through and is heated by a heater also in series with the regenerator. Further, the present invention includes an inertial piston which acts to store kinetic energy whereby the working fluid pressure may vary although the diaphragm is under constant pressures. The diaphragm member forms one wall of a hydraulic chamber. Working fluid is positioned between the displacer piston and the inertial piston. As the working fluid forces the inertial piston downwardly, the gas trapped between the working piston and the diaphragm forces hydraulic fluid out of the hydraulic chamber through a one-way outlet valve. As the pressure of the working fluid is reduced and the working piston moves upwardly, hydraulic fluid reenters the hydraulic chamber through a second one-way valve.

By actuating the displacer piston upwardly and downwardly, the inertial piston is actuated upwardly and downwardly and correspondingly permits hydraulic fluid to enter the hydraulic chamber and cyclically discharges hydraulic fluid from the hydraulic chamber.

In one embodiment of the present invention, the inertial piston is disposed within the hydraulic chamber. In this embodiment, the diaphragm member separates the displacer from the inertial piston. In another embodiment the hydraulic lines may be sized to provide sufficient inertial mass to act as the inertial piston so that no actual piston element is required.

It should be understood, that although specific reference is made to an inertial piston and a diaphragm that these elements may readily be replaced by a sliding seal as would be apparent to one with ordinary skill in this art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A free-piston regenerative engine comprising:

a piston chamber including an upper portion, a lower portion and a bottom;

a displacer piston slidably mounted to move through a stroke within said upper portion of said piston chamber, said displacer piston including a top surface area and a bottom surface area;

a heater, a regenerator and a cooler in communication with said piston chamber and being referenced to the top surface area and the bottom surface area of said displacer piston;

means for imparting motion to the displacer piston;

an inertial piston slidably mounted within said piston chamber;

a diaphragm positioned to move through a stroke at a lower portion of said piston chamber wherein a fluid chamber is defined between the diaphragm and said bottom of said piston chamber;

whereby fluid is supplied to and discharged from said fluid chamber in response to the movement of said displacer piston; and said displacer piston remaining stationary for a predetermined period of time at the end of said stroke to allow the diaphragm to complete its stroke prior to reversing the motion of said displacer piston, and wherein varying said predetermined period of time varies the engine frequency and output power.

2. A free-piston regenerative engine according to claim 1, wherein movement of said displacer piston displaces a working fluid contained within said piston chamber through said heater, regenerator and cooler.

3. A free-piston regenerative engine according to claim 2, wherein the displacement of said working fluid through said heater, regenerator and cooler cyclically transfers heat to and withdraws heat from the working fluid.

4. A free-piston regenerative engine according to claim 1, wherein said means for imparting motion to the displacer piston comprises a supply of high pressure and a supply of low pressure alternately supplied to an intermediate surface area of said displacer piston positioned between said top surface area and said bottom surface area.

5. A free-piston regenerative engine according to claim 4, wherein said supply of high pressure and low pressure is pneumatic.

6. A free-piston regenerative engine according to claim 4, wherein said supply of high pressure and low pressure is hydraulic.

7. A free-piston regenerative engine according to claim 1, including an electromagnetic means for imparting motion to the displacer piston.

8. A free-piston regenerative engine according to claim 4, wherein said supply of high pressure and low pressure is generated by said engine.

9. A free-piston regenerative engine according to claim 1, wherein said displacer piston and said inertial piston are positioned adjacent each other one one side of said diaphragm.

10. A free-piston regenerative engine according to claim 1, wherein said displacer piston is separated from said inertial piston by said diaphragm.

11. A free-piston regenerative engine comprising:

a piston chamber including an upper portion, a lower portion and a bottom;

a displacer piston slidably mounted within said upper portion of said piston chamber, said displacer piston includes a top surface area and a bottom surface area;

a heater, a regenerator and a cooler in communication with said piston chamber and being referenced to the top surface area and the bottom surface area of said displacer piston;

means for imparting motion to the displacer piston; and a diaphragm positioned at a lower portion of said piston chamber wherein a fluid chamber is defined between the diaphragm and said bottom of said piston chamber;

whereby fluid supplied to and discharged from said fluid chamber in response to the movement of said displacer piston functions as an inertial mass.

12. A free-piston regenerative engine according to claim 11, wherein movement of said displacer piston displaces a working fluid contained within said piston chamber through said heater, regenerator and cooler.

13. A free-piston regenerative engine according to claim 12, wherein the displacement of said working fluid through said heater, regenerator and cooler, cyclically transfers heat to and withdraws heat from the working fluid.

14. A free-piston regenerative engine according to claim 11, wherein said means for imparting motion to the displacer piston comprises a supply of high pressure and a supply of low pressure alternately supplied to an intermediate surface area of said displacer piston positioned between said top surface area and said bottom surface area.

15. A free-piston regenerative engine according to claim 14, wherein said supply of high pressure and low pressure is pneumatic.

16. A free-piston regenerative engine according to claim 14, wherein said supply of high pressure and low pressure is hydraulic.

17. A free-piston regenerative engine according to claim 11, including an electromagnetic means for imparting motion to the displacer piston.

18. A free-piston regenerative engine according to claim 14, wherein said supply of high pressure and low pressure is generated by said engine.

* * * * *